United States Patent [19]

Williamson

[11] Patent Number: 4,714,186

[45] Date of Patent: Dec. 22, 1987

[54] FASTENER DRIVING TOOL

[76] Inventor: Reno S. Williamson, Rte. 1, Box 223, Nakina, N.C. 28455

[21] Appl. No.: 854,500

[22] Filed: Apr. 22, 1986

[51] Int. Cl.[4] ..... B25C 1/00; B25C 1/02

[52] U.S. Cl. ..... 227/146; 173/84; 227/129; 227/147; 227/156

[58] Field of Search ..... 173/30, 84, 119; 227/7, 227/120, 129, 132, 146, 156, 147

[56] References Cited

U.S. PATENT DOCUMENTS

| | | | |
|---|---|---|---|
| 858,322 | 6/1907 | Bandimere | 173/84 |
| 1,021,121 | 3/1912 | Willis | 173/84 X |
| 1,409,419 | 3/1922 | Signell | 227/146 |
| 2,052,440 | 8/1936 | Barrett | 227/132 |
| 2,884,636 | 5/1959 | Abrams | 227/132 |
| 2,968,810 | 1/1961 | Young | 227/147 |
| 3,243,093 | 3/1966 | Schoefer, Jr. et al. | 227/146 |
| 3,506,178 | 4/1970 | Brunelle | 227/10 |
| 4,215,808 | 8/1980 | Sollberger et al. | 227/132 X |
| 4,405,071 | 9/1983 | Austin | 227/7 |

FOREIGN PATENT DOCUMENTS

| | | | |
|---|---|---|---|
| 2496731 | 6/1982 | France | 173/119 |

*Primary Examiner*—Paul A. Bell

*Attorney, Agent, or Firm*—Parkhurst & Oliff

[57] ABSTRACT

A fastener driving tool comprising a spring activated hammer, wherein the hammer is manually cocked. A foot actuated cocking mechanism is disclosed for cocking the hammer.

20 Claims, 4 Drawing Figures

FASTENER DRIVING TOOL

FIELD OF THE INVENTION

The present invention relates to a new and improved tool for driving fasteners such as nails or the like into a workpiece.

BACKGROUND OF THE INVENTION

Pneumatic, electrical and mechanical fastener driving tools are known. However, such tools having sufficient power to drive nails or the like are quite heavy and bulky, and generally require sources of pneumatic or electrical energy. Such devices are exemplified in U.S. Pat. No. 3,243,093 and U.S. Pat. No. 4,405,071. These devices commonly weigh as much as thirty or forty pounds, thus making their use difficult and inconvenient under many circumstances. Furthermore, their dependence on outside power sources limits their use in remote areas.

SUMMARY OF THE INVENTION

The fastener driving tool of the present invention is lightweight and compact, and requires no outside power sources. The device utilizes a minimum of moving parts, and is quite rugged and reliable. It is also quite flexible in its operation.

The fastener driving tool of the invention comprises a fastener driver including a housing, a reciprocative hammer within the housing and a spring which drives the hammer toward an open, active end of the housing. A trigger mechanism may be used to maintain the hammer in a raised position against the force of the spring prior to actuation of the hammer by pulling the trigger. A fastener magazine is releasably attached at the open end of the housing to feed fasteners such as nails into the housing below the hammer.

The hammer is cocked manually against the driving force of the spring. In a preferred embodiment, the hammer is cocked via a foot-actuated cocking device which may be fastened to a user's leg. Simple up and down foot movement cocks the fastener driving tool without need for outside power sources.

DETAILED DESCRIPTION OF PREFERRED EMBODIMENTS OF THE INVENTION

Figure 1:
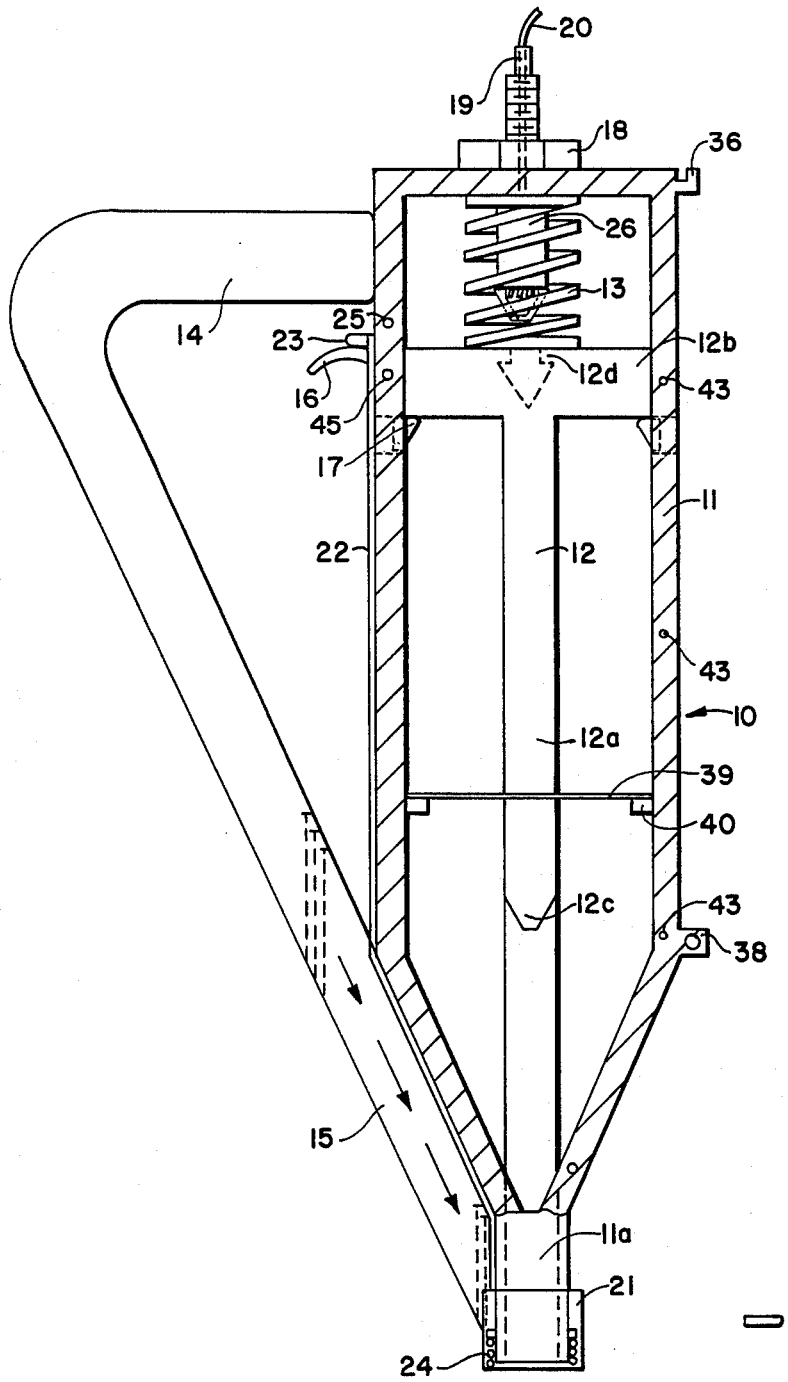
FIG. 1 is a cross-sectional view of a fastener driver portion of a fastener driving tool according to the invention.

With reference to FIG. 1, the fastener driver 10 comprises a housing 11 containing a reciprocative hammer 12 designed to contact a fastener with impact end 12*c* to drive the fastener into a workpiece. Driver housing 11 may taper inwardly at its open end to a fastener chamber 11*a* which is fed with fasteners such as nails from a fastener magazine 15. Fastener magazines of the type contemplated are known in the art; see, for example, U.S. Pat. No. 3,243,092. Hammer 12 is preferably tapered at its impact end 12*c* to focus driving force on the head of a fastener in chamber 11*a*. Hammer 12 also includes a cross-sectionally T-shaped head 12*b* which guides hammer 12 in a piston-like fashion within driver housing 11.

Spring 13 provides a downward force against hammer 12 within housing 11. While spring 13 is preferably a compression-type coil spring as depicted in FIG. 1, other types of springs such as a tension spring or the like may be utilized for the same effective force. An adjustment device 18 such as a hex nut may be included to adjust the pressure of spring 13.

Figure 4:
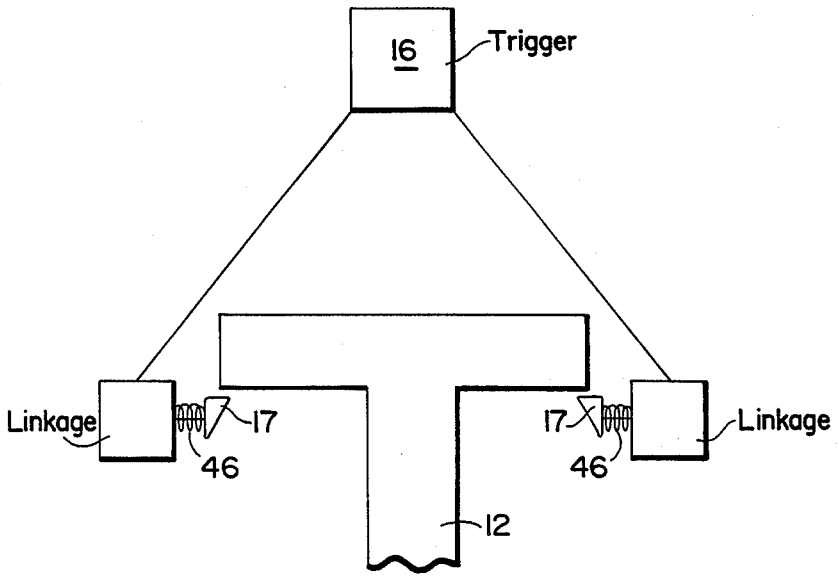
FIG. 4 is a general view of the trigger mechanism.

The fastener driving tool includes handle 14 closely associated with trigger 16. The trigger mechanism includes supports 17 which support hammer 12 in a cocked position in which spring 13 is compressed between housing 11 and hammer 12. Trigger mechanism 16, 17 is of a conventional type shown schematically in FIG. 4. It may include a rounded or sloped bottoms on supports 17 to permit supports 17 to be pushed out of the way by hammer 12 when hammer 12 rises against supports 17. The top faces of supports 17 prevent downward motion of hammer 12 until supports 17 are withdrawn (against spring 46 pressure or the like) into a recess in the housing upon actuation of trigger 16, which supports 17 are mechanically linked, to allow hammer 12 to be forced rigidly downward by spring 13.

A safety device shown at 21, 22, 23, 24 may be included to prevent actuation of trigger 16 when the open end of the fastener driver is not pressed against a workpiece. Such safety devices are known in the art. In the device shown, a safety head 21 is biased away from housing 11 by spring 24. Safety head 21 is attached via safety body 22 to safety stop 23 which holds trigger 16 against actuation. When safety head 21 is pressed against a workpiece to overcome the force of spring 24, safety body 22 and safety stop 23 move along housing 11 to free trigger 16 for actuation. In an optional embodiment, a pin 25 may be provided to hold the safety device in an inoperative position. The utility of a safety override pin 25 will be discussed further below.

Figure 2:
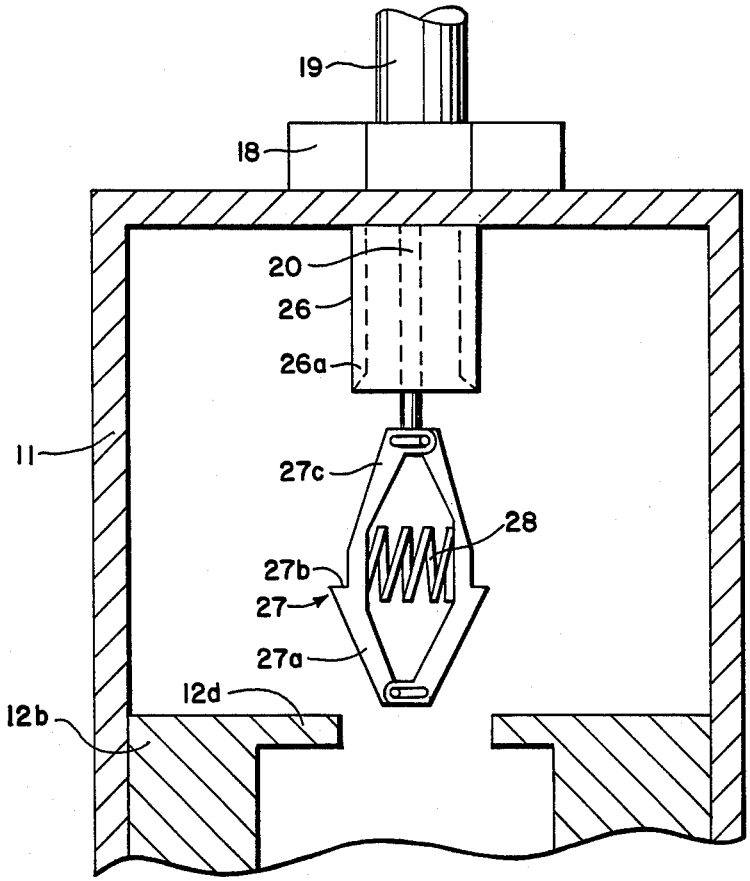
FIG. 2 is an enlarged partial cross-sectional view of the fastener driver of FIG. 1.

At its head 12*b*, hammer 12 includes an attaching means, depicted as a cavity defined by hammer head 12*b* and flanges 12*d* in FIGS. 1 and 2. This attaching means is designed to be releasably connected to a cocking mechanism. A preferred releasable connector is depicted in detail in FIG. 2 (from which spring 13 has been removed for clarity).

As shown in FIG. 2, cocking cable 20 passes through a tube 26 attached to driver housing 11. Cocking cable 20 is connected at one end to connector 27 which cooperates with flanges 12*d* to lift hammer 12 in housing 11. In operation, connector 27 would be pressed downwardly into the cavity in hammer head 12*b*. As connector 27 moves downwardly, lower sloped portion 27*a* contacts flanges 12*d*, thereby compressing relatively weak spring 28 to permit connector 27 to enter the cavity. When step 27*b* passes flange 12*d*, spring 28 will expand connector 27. Connector 27 is then retracted toward tube 26 by cable 20, and step 27*b* lifts hammer 12 via flanges 12*d*.

As connector 27 lifts hammer head 12*b* past supports 17, supports 17 retract into housing 11. When hammer head 12*b* passes supports 17, supports 17 move back out of their retracted position as a function of spring biasing (not shown) on supports 17. As connector 27 and hammer 12 continue to rise, upper end 27*c* of connector 27 enters tube 26, which preferably includes a flared or beveled end 26*a*. When the sloping edges of upper end 27*c* of connector 27 enter tube 26, connector 27 is gradually compressed against the force of spring 28, and stop 27b will move radially inwardly until it no longer supports flanges 12d. Hammer 12 is then released from connector 27 and is biased by spring 13 to seat on supports 17. Preferably, a safety device (not shown) is provided to prevent connector 27 from re-entering the cavity until trigger 16 has been actuated.

The tool is then ready for firing by pressing safety head 24 against the workpiece and actuating trigger 16 to withdraw supports 17 from under hammer head 12b, allowing spring 13 to shoot hammer 12 downwardly against a fastener inside of fastener chamber 11a, thereby forcing the fastener out of the open end of the fastener driver into the workpiece.

Stopper 39 is preferably provided to prevent overtravel of hammer 12. Stopper 39 may, for example, comprise a rubber or plastic washer attached to housing 11, for instance via annular ledge 40. Stopper 39 maintains substantially all of hammer 12 within housing 11 after firing, and restricts the distance connector 27 must travel to connect with hammer head 12b to return hammer 12 to the cocked position.

In a preferred embodiment, housing 11 includes access panels (not shown) which permit access to hammer 12 and spring 13 so that either or both may be readily interchanged. The access panels may be held in place by a series of screws 43 to seal the inside of the housing against dust and grit which might impair operation of the tool. For instance, to drive sixteen-penny nails, a spring providing 120 pounds of pressure is very suitable. To provide such pressure, a helical compression spring with closed and ground ends having a one and one-half inch diameter, a seven inch length and comprising 19 coils of 3/16th inch diameter wire is suitable. If 130 pounds of pressure are desirable for certain operations, such a spring could be replaced by a helical compression spring with closed and ground ends having a two inch diameter, a ten inch length and twenty-four coils of one-fourth inch diameter wire. If less pressure is desired, the instance for smaller nails or staples, a weaker spring could be substituted through the access panels. Furthermore, for small force changes, the spring force may be adjusted by rotating hex nut 18.

Figure 3:
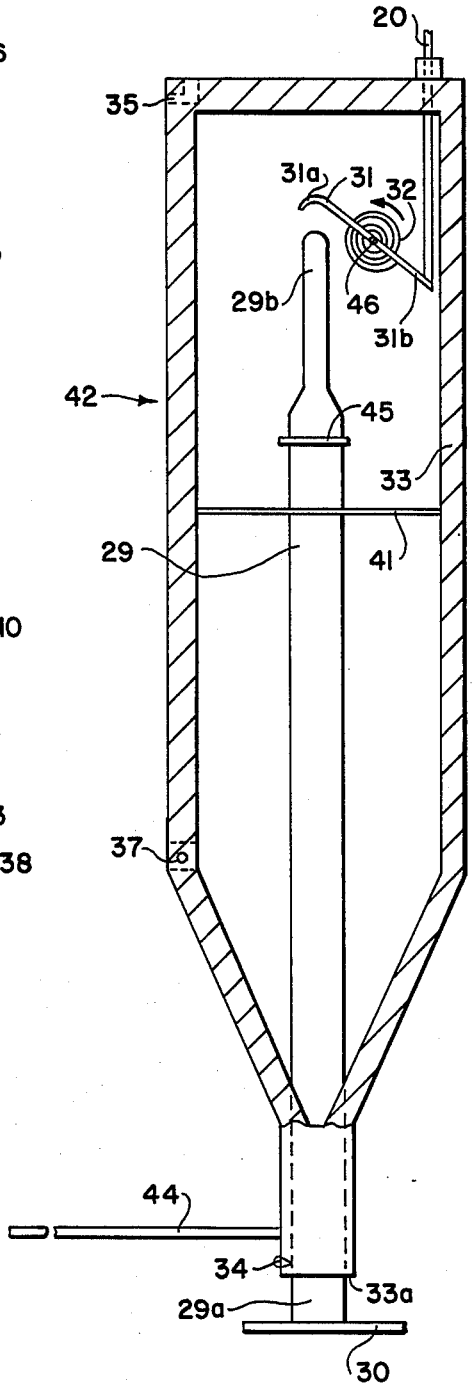
FIG. 3 is a cross-sectional view of a foot actuated portion of a cocking mechanism for the fastener driving tool of FIG. 1.

In a preferred embodiment, the fastener driving tool is cocked with a foot-actuated cocking mechanism 42 (FIG. 3). This mechanism comprises leg housing 33 which may be attached to a user's leg by straps or the like. Leg housing 33 is preferably shaped so as comfortably to fit on either the right or left leg of the user. Cocking mechanism 42 includes a rod or cocking leg 29 which extends most of the length of leg housing 33. Housing 33 is open at end 33a so that cocking leg 29 may extend therethrough. Plate 30 may be connected to the end 29a of cocking leg 29 outside of leg housing 33 to maintain the stability of cocking leg 29 and distribute forces on a surface against which cocking leg 29 may be pressed. Ledge 45 and stopper 41 may be provided to keep cocking leg 29 from falling out of housing 33. In a preferred embodiment, upper end 29b of cocking leg 29 abuts (and may optionally be attached to) one end 31a of lever 31 which pivots about pivot point 46. The other end 31b of lever 31 is connected to cocking cable 20. Lever 31 is biased by relatively weak spring 32 so that end 31a presses downward on cocking leg 29 and end 31b presses upward on cocking cable 20 when plate 30 is free. In an alternative embodiment, cocking leg 29 may be operatively connected to cocking cable 20 via a series of gears in leg housing 33.

In operation, cocking mechanism 42 is fastened to the user's leg, with pedal 44 connected to housing 33 located under the user's foot. When the user raises his or her foot, spring 32 biases rod 29 downward and simultaneously biases cable 20 upward (FIG. 3) through cable shield 19. At its other end, cable 20 is therefore forced downward (FIGS. 1 and 2), moving connector 27 into the cavity in hammer head 12b. The user then presses his or her foot downward against pedal 44, pressing plate 30 against a floor surface. This forces cocking leg 29 against end 31a of lever 31, pulling end 31b and cocking cable 20 downward (FIG. 3). This in turn pulls connector 27 and hammer 12 upward in housing 11 against the force of spring 13 until hammer head 12b rises above supports 17 and the upper end 27c of attaching means 27 enters tube 26. As described above, connector 27 is thereupon released from hammer head 12b and the fastener driving tool is fully cocked and ready to fire as described above.

As can be seen from the above description, the fastener driving tool of the present invention may be easily cocked and fired by an individual user without the need for any external power sources. It is fully self-contained. In the preferred embodiment described, the device is fully mechanical, and requires no pressure hoses or chambers which might wear and leak after extended usage. The device comprises a small number of moving parts which can be fashioned of lightweight but strong materials. The tool is readily used in substantially any working situation where the user can brace his or her leg against a floor or wall or the like.

The fastener driving tool may be particularly well adapted to floor fastening by provision of locks 35, 36, 37, 38, safety override 25 and trigger override 45. In this optional configuration, foot-actuated cocking mechanism 42 may be attached directly to fastener driver 10 by connecting locks 35, 36, and 37, 38, respectively. A short cable 20 or a cable tie (not shown) may be used in this configuration to avoid tripping. When safety override 25 and trigger override 45 (which may be incorporated into a single mechanism) are activated, fasteners may be fired downwardly into a floor simply by walking along the floor. As the user lower his or her leg to which the tool is attached, rod 30 is forced upwardly to raise hammer 12 in housing 11. Supports 17 are maintained in a fully retracted position by trigger override 45 and safety override 25. As connector 27 rises into tube 26, hammer 12 is automatically released and a fastener is driven into the floor. As the user then lifts his or her leg for the next step, spring 32 drives rod 29 downwardly and cable 20 upwardly to re-connect connector 27 with hammer 12, thus re-initiating the cycle.

When the user desires to walk without using the fastener driving tool, cocking leg 29 may be maintained in a raised position by a pin 34 (FIG. 3). This maintains connector 27 in a raised position so that spring 13 is relaxed and hammer head 12b rest on stopper 39 or supports 17. When the user desires to begin using the tool again, he or she simply deactivates pin 34 and raises and lowers his or her leg, thereby fully cocking the tool.

The present invention has been described in terms of particularly preferred embodiments. However, it is clear that minor modifications to the device may be made without departing from the scope and spirit of the invention. Thus the examples described above should not be considered as limiting, and the scope of the invention is to be construed as broadly as permitted by the appended claims.

What is claimed is:

1. A fastener driving tool comprising:

a fastener driver housing of a size adapted to be carried by a user and having at least one open end;

hammer means reciprocative within said fastener driver housing toward and away from said open end;

bias means within said fastener driver housing for biasing said hammer means toward said open end;

trigger means on said fastener driver housing for releasably holding said hammer means in a cocked position away from said open end in opposition to said bias means;

a cocking means housing of a size adapted to be carried by said user and containing cocking means adapted to be actuated by said user's foot, said cocking means being further adapted to move said hammer means away from said open end in opposition to said bias means; and connecting means for operably connecting said cocking means to said hammer means.

2. A fastener driving tool according to claim 1, wherein said bias means comprises spring means.

3. A fastener driving tool according to claim 1, wherein said hammer means has a T-shaped cross section.

4. A fastener driving tool according to claim 1, wherein said connecting means comprising releasable connector means engageable with said hammer means, said connector means being disengaged from said hammer means when said hammer means is in said cocked position.

5. A fastener driving tool according to claim 4, wherein said hammer means comprises a cavity for releasably engaging said connector means.

6. A fastener driving tool according to claim 5, wherein said connector means comprises an expandable hook.

7. A fastener driving tool according to claim 5, comprising release means associated with said fastener driver housing which acts upon said connector means to release said connector means from said cavity when said hammer means is in said cocked position.

8. A fastener driving tool according to claim 7, wherein said connector means comprises an expandable hook and said release means comprises a tube having a radially outwardly flared opening.

9. A fastener driving tool according to claim 1, wherein said cocking means housing comprises means for releasably fastening said cocking means housing to at least one of a user's leg and foot.

10. A fastener driving tool according to claim 9, wherein said cocking means comprises a reciprocative cocking means within said leg housing.

11. A fastener driving tool according to claim 10, wherein said cocking means housing has at least one open end and said cocking leg extends through said open end.

12. A fastener driving tool according to claim 11, further comprising attachment means for attaching said fastener driver housing to said cocking means housing with said open end of said fastener driver housing being adjacent to and parallel to said open end of said cocking means.

13. A fastener driving tool according to claim 12, wherein said tool further comprises a trigger override which disengages said trigger means when said fastener driver housing is attached to said cocking means housing.

14. A fastener driving tool according to claim 10, wherein said connecting means comprises releasable connector means engageable with said hammer means, said connector means being disengaged from said hammer means when said hammer means is in said cocked position.

15. A fastener driving tool according to claim 14, wherein said cocking leg is operatively connected to said connector means.

16. A fastener driving tool according to claim 15, wherein movement of said cocking leg toward the interior of said cocking means housing produces movement of said connector means away from said open end of said fastener driver housing.

17. A fastener driving tool according to claim 11, wherein movement of said cocking leg away from the interior of said cocking means housing produces movement of said connector means toward said open end of said fastener driver housing.

18. A fastener driving tool according to claim 15, comprising release means associated with said fastener driver housing which acts upon said connector means to release said connector means from a cavity in said hammer means when said hammer means is in said cocked position.

19. A fastener driving tool according to claim 15, wherein said cocking leg is operatively connected to said connector means via a shielded cable.

20. A fastener driving tool according to claim 19, wherein motion of said cocking leg toward the interior of said cocking means housing produces motion of said cable toward the interior of said cocking means housing.

* * * * *